US006807777B2

(12) United States Patent
Wagner et al.

(10) Patent No.: US 6,807,777 B2
(45) Date of Patent: Oct. 26, 2004

(54) DOOR SPACER BLOCK

(76) Inventors: John Wagner, 405 N. Carter, Palatine, IL (US) 60067; Joseph Ratliff, 301 S. Old Rand Rd., Lake Zurich, IL (US) 60047; Richard Zochowski, 680 Gardenia, Bartlett, IL (US) 60103

( * ) Notice: Subject to any disclaimer, the term of this patent is extended or adjusted under 35 U.S.C. 154(b) by 0 days.

(21) Appl. No.: 10/229,881

(22) Filed: Aug. 28, 2002

(65) Prior Publication Data

US 2003/0056441 A1 Mar. 27, 2003

Related U.S. Application Data

(60) Provisional application No. 60/316,947, filed on Aug. 30, 2001.

(51) Int. Cl.[7] ..... E06B 1/04; E04F 21/00

(52) U.S. Cl. ..... 52/204.1; 52/127.1; 52/105; 52/DIG. 1; 52/DIG. 4; 33/194; 33/645; 269/905

(58) Field of Search ..... 52/204.1, 210, 52/127.1, 749.1, 105, DIG. 1, DIG. 4; 269/905; 33/194, 404, 474, 429, 481, 645

(56) References Cited

U.S. PATENT DOCUMENTS

| | | | | | |
|---|---|---|---|---|---|
| 2,636,527 | A | * | 4/1953 | Schiemann | 269/45 |
| 3,852,935 | A | * | 12/1974 | Jones | 52/731.1 |
| 4,925,074 | A | * | 5/1990 | Wood | 228/49.1 |
| 4,989,336 | A | * | 2/1991 | Waltrip et al. | 33/526 |
| 5,388,813 | A | * | 2/1995 | Arsenault | 269/41 |
| 5,737,844 | A | * | 4/1998 | Brumley | 33/194 |
| 5,758,466 | A | * | 6/1998 | Tucker | 52/586.2 |
| 5,775,036 | A | * | 7/1998 | Stanley, Sr. | 52/127.2 |
| 5,775,045 | A | * | 7/1998 | Hill | 52/211 |
| 5,813,125 | A | * | 9/1998 | Byrn | 33/451 |
| 5,913,546 | A | * | 6/1999 | Kuchenbrod et al. | 29/464 |
| 6,327,786 | B1 | * | 12/2001 | Felix | 33/474 |
| 6,532,674 | B2 | * | 3/2003 | Farese | 33/194 |
| 6,637,158 | B2 | * | 10/2003 | Bennett | 49/504 |
| 2002/0170189 | A1 | * | 11/2002 | Cheatham | 33/194 |
| 2003/0005589 | A1 | * | 1/2003 | Hale et al. | 33/194 |
| 2004/0000061 | A1 | * | 1/2004 | Tuthill | 33/194 |

FOREIGN PATENT DOCUMENTS

| | | | | |
|---|---|---|---|---|
| JP | 10037580 | A | * 2/1998 | E05D/15/06 |

* cited by examiner

*Primary Examiner*—Brian E. Glessner
(74) *Attorney, Agent, or Firm*—McAndrews, Held & Malloy, Ltd.

(57) ABSTRACT

An apparatus to aid in the accurate installation of a frame by establishing a required gap and alignment is disclosed. The apparatus comprises a block of material with pre-determined dimensions related to the standard or custom dimensions of the frame and standard or custom dimensions of a subsequent stud and dry wall to be installed. The block of material has a slot running along the length of at least one side with the slot having a pre-determined depth and width corresponding to standard or custom dimensions of an outer lip of the frame to be installed for fitting the block of material onto the outer lip. A securing system for temporarily securing the block of material to the outer lip is also provided. The slot is offset from an edge of the block of material by a distance corresponding to the required gap and alignment to be established.

9 Claims, 13 Drawing Sheets

DOOR SPACER BLOCK

RELATED APPLICATIONS

The applicants claim priority based on provisional application No. 60/316,947 filed Aug. 30, 2001, the complete subject matter of which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Certain embodiments of the present invention relate to the field of construction, particularly, the installation of metal frames for doors and windows by a carpenter. When metal doorframes or metal windows are to be installed, it is necessary for the carpenter to establish the proper gap between the vertical frame supports and the metal track on the floor to allow space for subsequent installation of dry wall material. Also, alignment of the vertical metal stud to the metal frame is required before affixing the stud to the metal frame. Typically, measurements or calculations of distances with a tape measure and/or other tools is required. Also, the metal stud would need to be somehow clamped and secured in the correct position before affixing to the frame. It is desired to eliminate the need for these steps, minimizing installation time and maximizing craftsmanship of frame installation.

Further limitations and disadvantages of conventional and traditional approaches will become apparent to one of skill in the art, through comparison of such systems with embodiments of the present invention as set forth in the remainder of the present application with reference to the drawings.

BRIEF SUMMARY OF THE INVENTION

An embodiment of the present invention provides for the accurate installation of a frame such as a door frame or a window frame.

An apparatus is disclosed to aid in the accurate installation of a frame by establishing a desired gap and alignment. The apparatus comprises a block of material with predetermined dimensions related to the standard or custom dimensions of the frame and standard or custom dimensions of a subsequent stud and dry wall to be installed. The block of material has a slot running along the length of at least one side with the slot having a pre-determined depth and width corresponding to standard or custom dimensions of an outer lip of the frame to be installed for fitting the block of material onto the outer lip. A securing system for temporarily securing the block of material to the outer lip is also provided. The slot is offset from an edge of the block of material by a distance corresponding to the required gap and alignment to be established.

Certain embodiments of the present invention afford an approach to accurately install a door frame or window frame using at least one single block of material with certain standard or custom dimensions to provide a proper gap and alignment.

DETAILED DESCRIPTION OF THE INVENTION

Figure 1A:
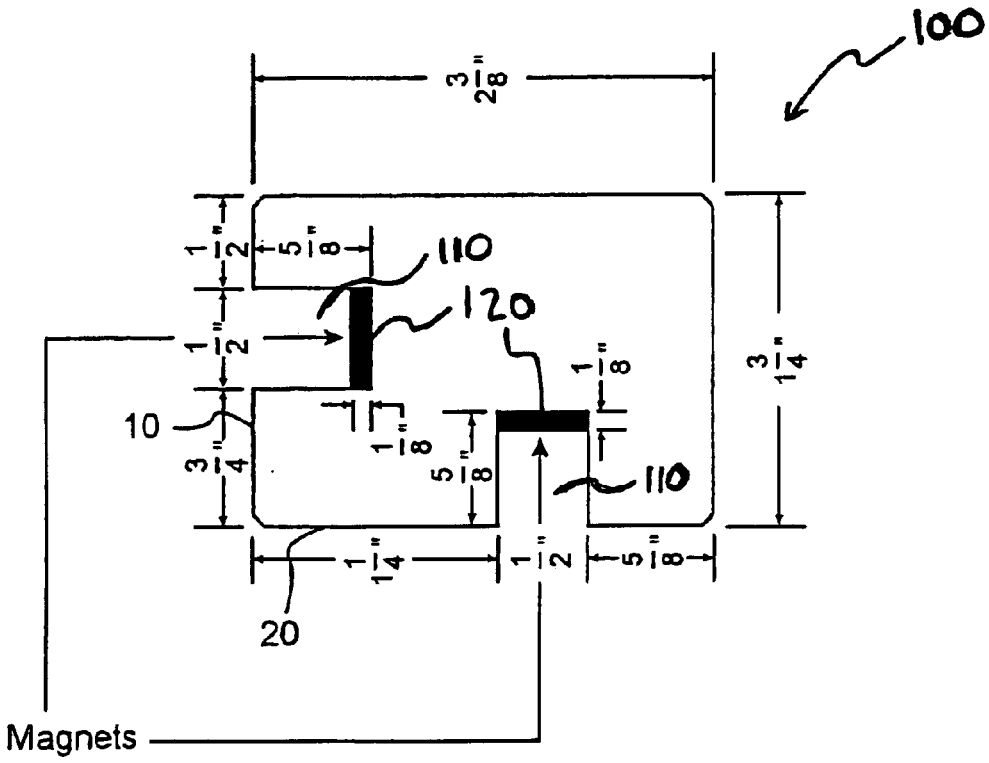
FIGS. 1A–1F illustrate the dimensions of a block of material with slots in accordance with an embodiment of the present invention.
Figure 1B:
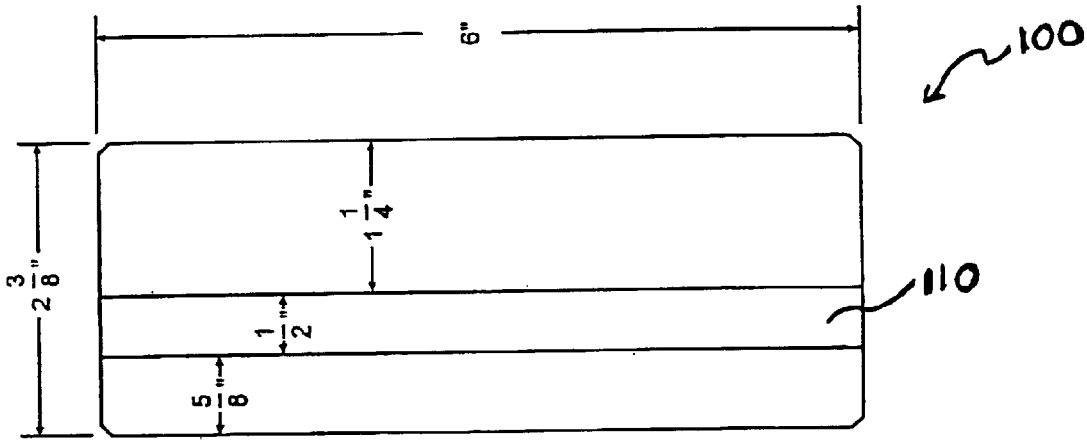
Figure 1C:
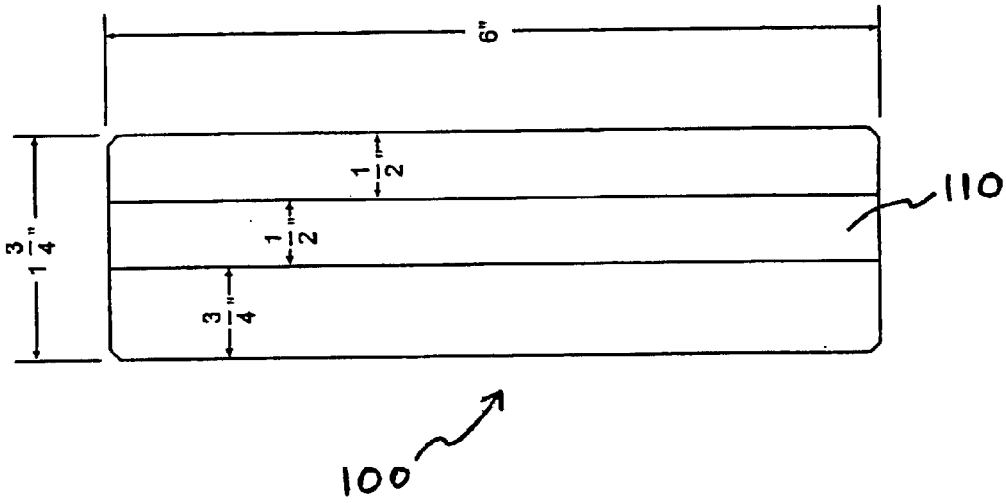
Figure 1D:
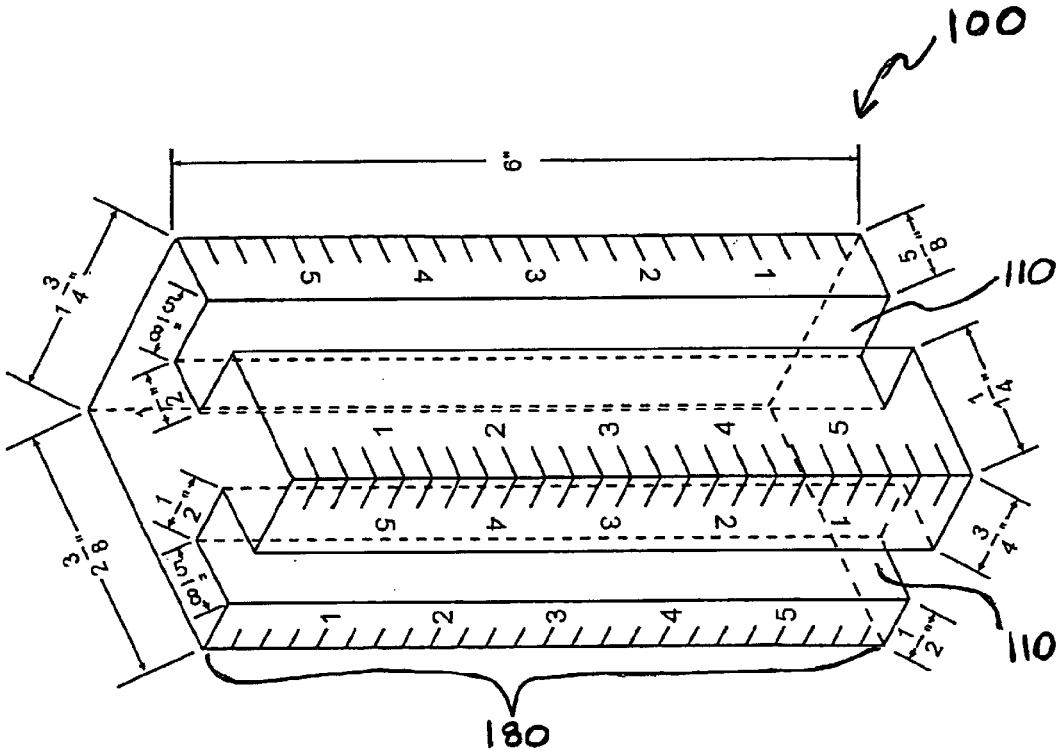
Figure 1E:
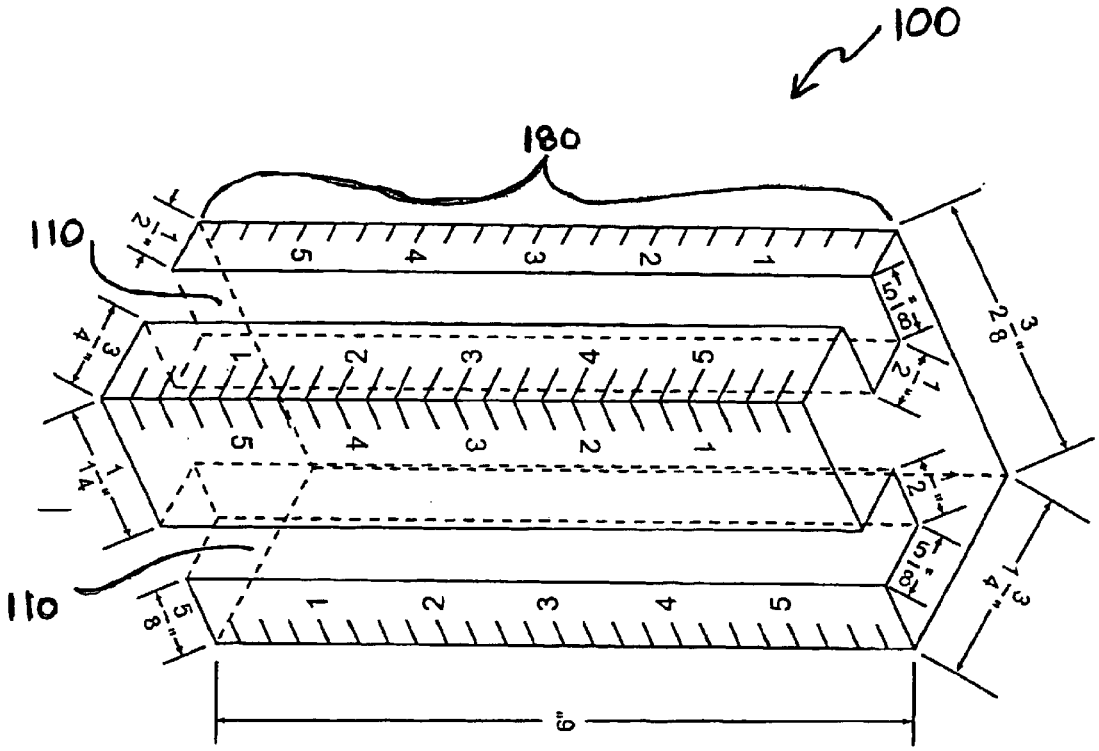
Figure 1F:
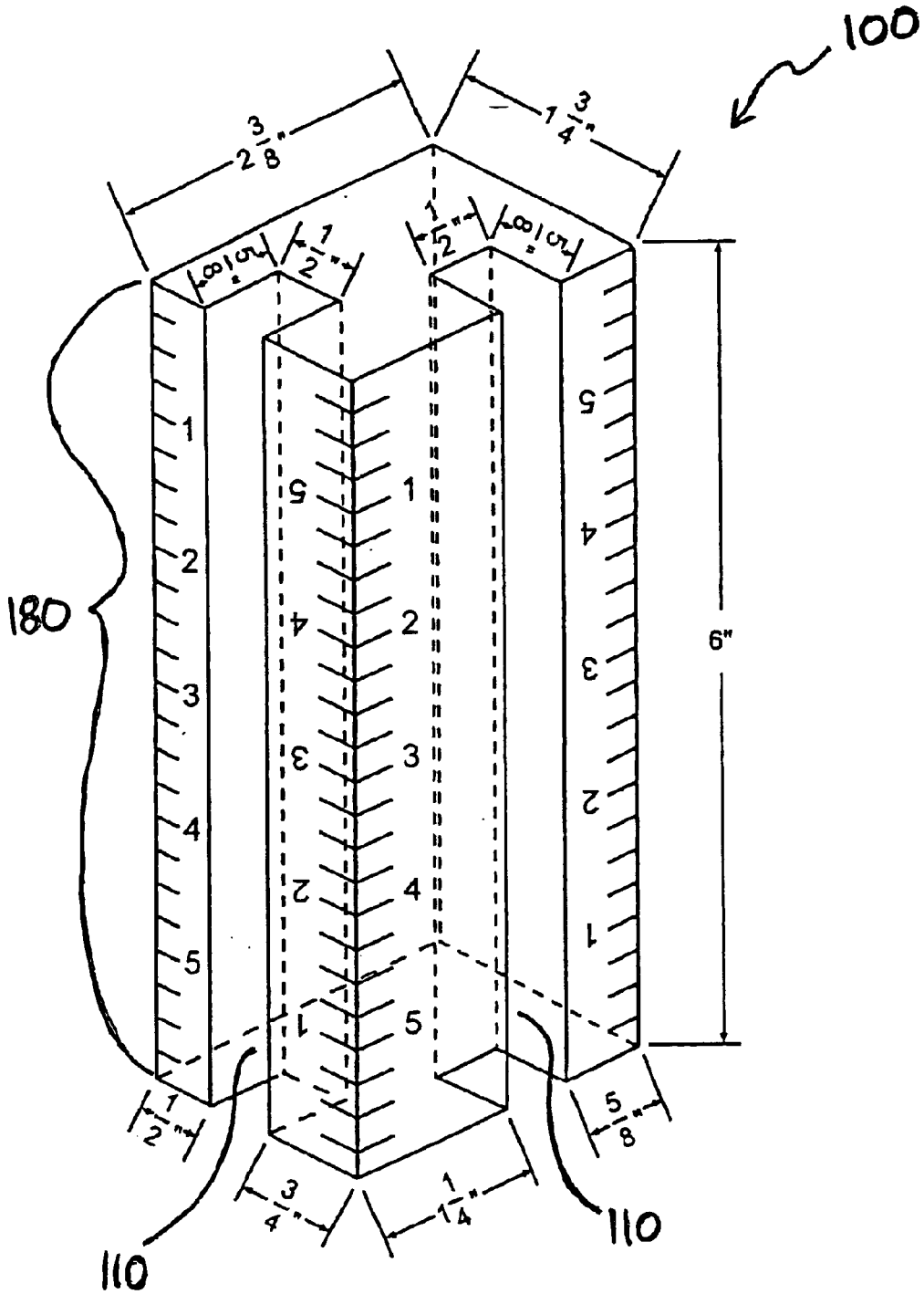

FIGS. 1A–1F illustrate a new construction tool 100 that allows for quick and accurate installation of hollow metal doorframes and windows in accordance with an embodiment of the present invention. The tool 100 is a rectangular block made from a durable material such as wood, metal, plastic, or other materials. According to an embodiment of the present invention, the rectangular block is typically 3 to 6 inches long with a width dimension of 1¾ inches and a thickness dimension of 2⅜ inches, as illustrated in FIGS. 1A–1F. A slot 110 that is ⅝ inch deep and ½ inch wide is cut out of sides 10 and 20 along its entire length (see FIG. 1A). The bottom of the slot 110 is equipped with a securing system 120 such as a magnet. This magnet is used to temporarily affix the tool 100 to the outside edge of a metal doorframe 130, so as to allow for hands-free operation.

Figure 2A:
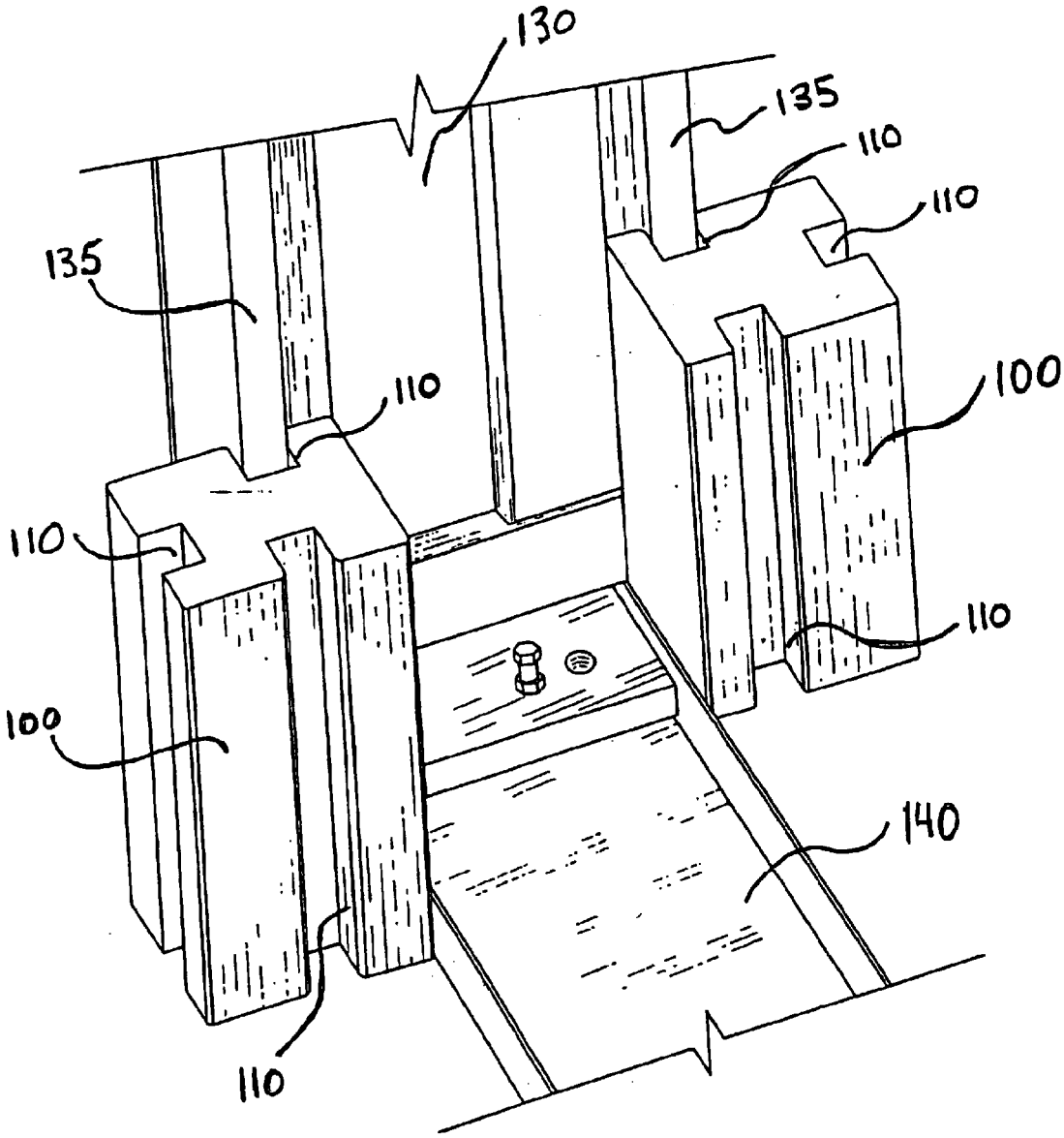
FIGS. 2A–2G illustrate how the block of material of FIGS. 1A–1F may be used to install a door frame in accordance with an embodiment of the present invention.
Figure 2B:
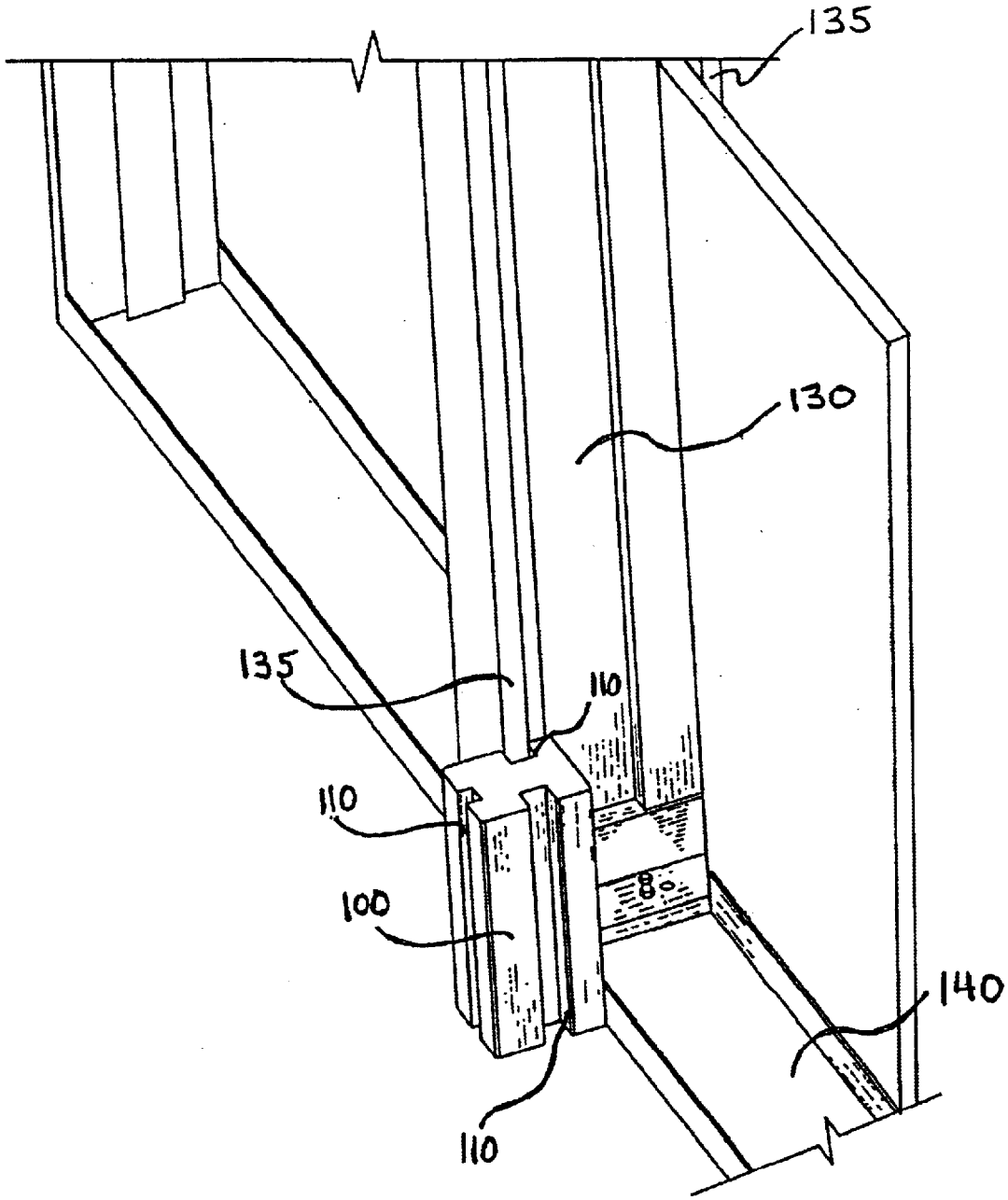
Figure 2C:
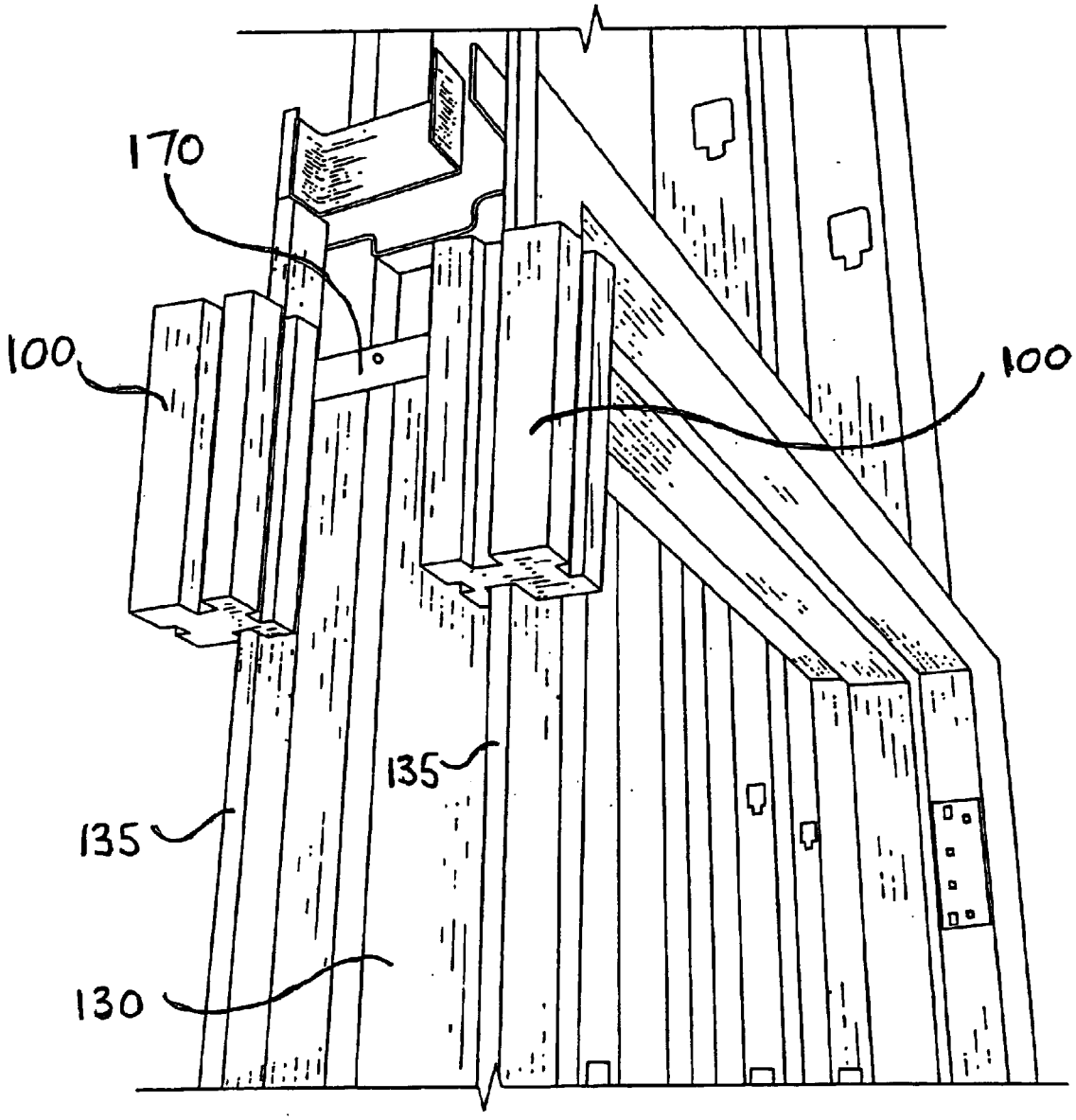
Figure 2D:
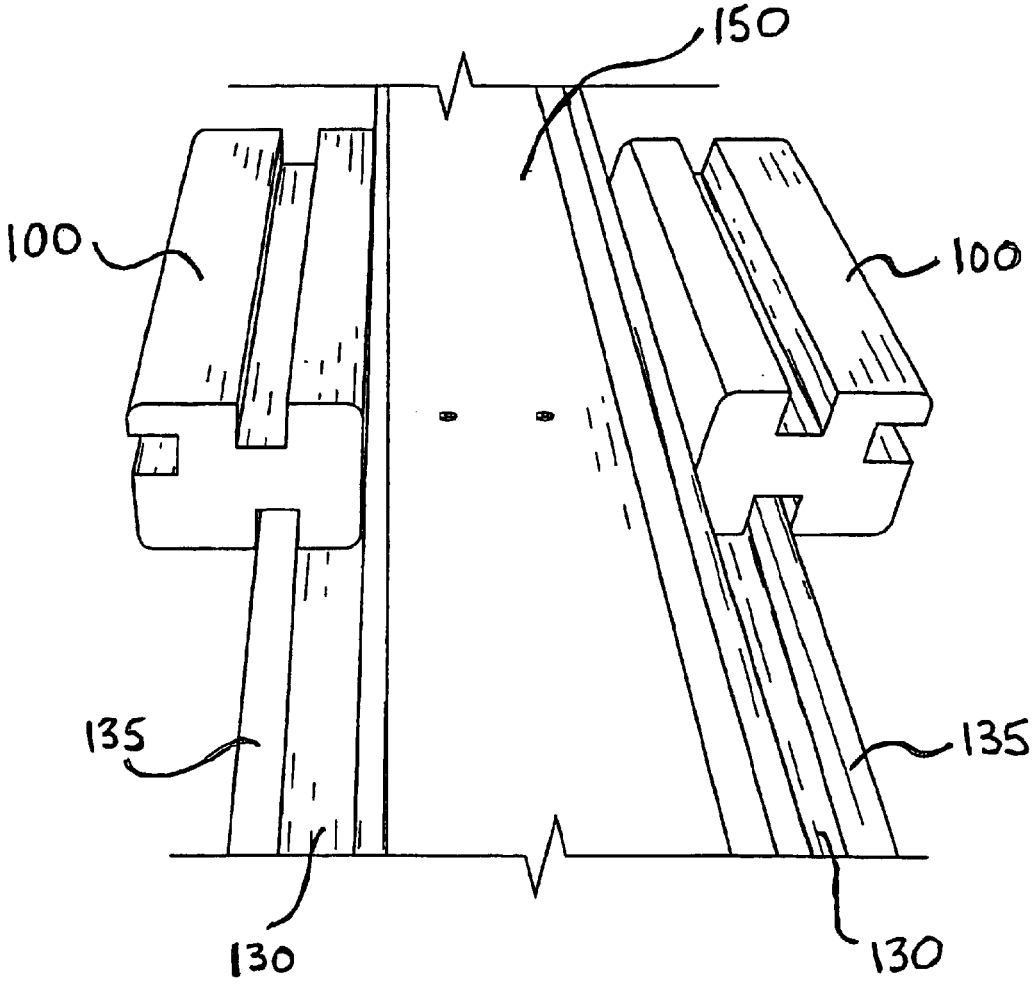
Figure 2E:
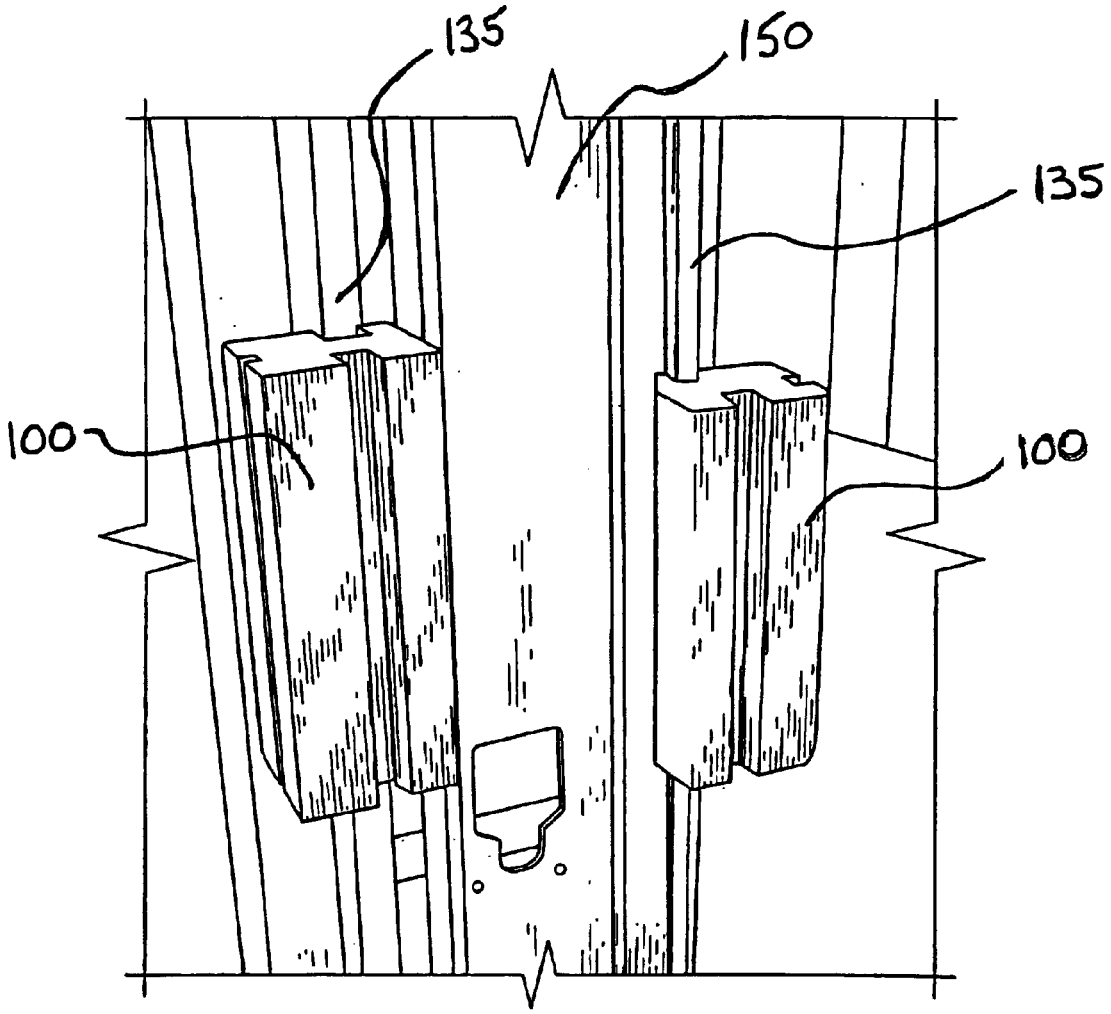
Figure 2F:
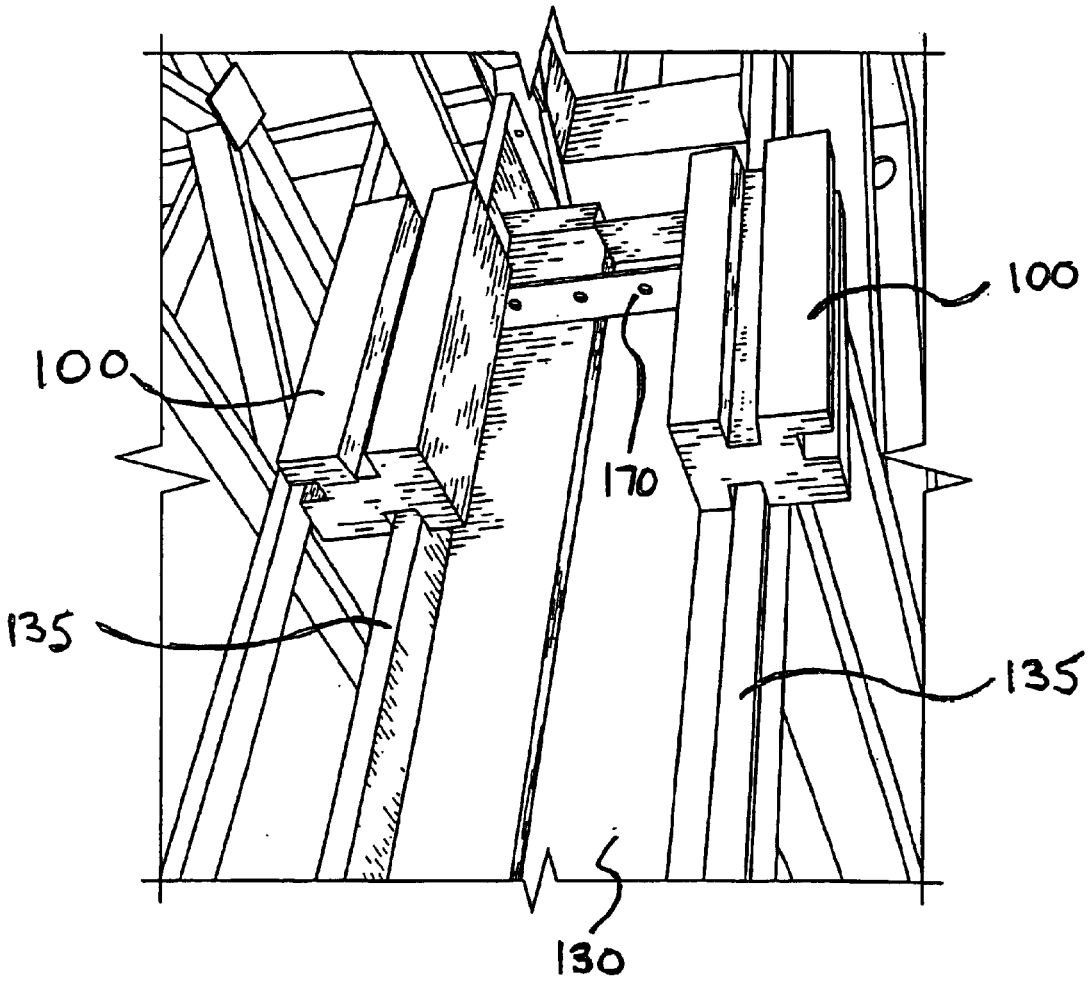
Figure 2G:
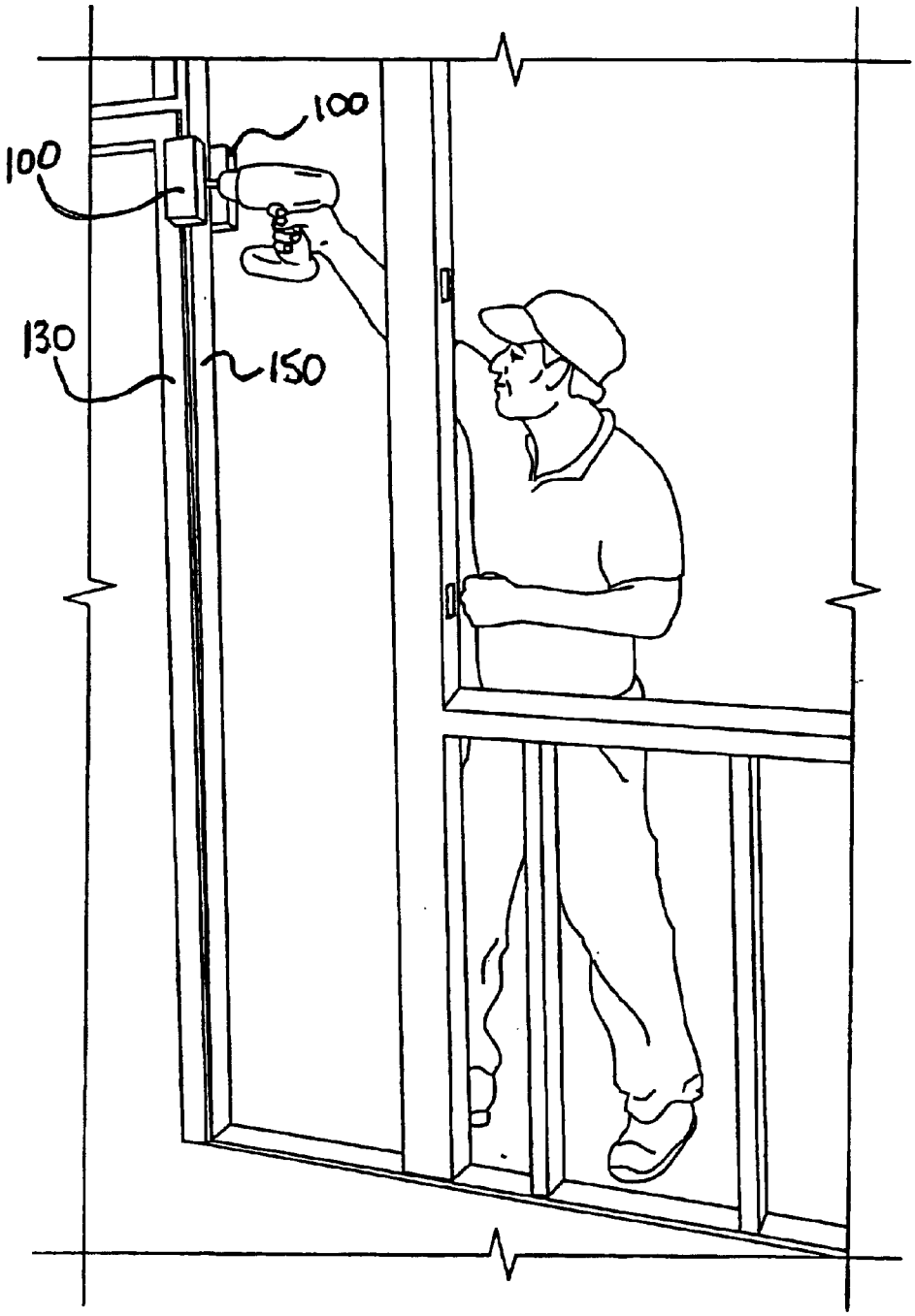

An embodiment of the present invention allows two measuring tasks to be completed accurately and more efficiently without the use of measuring tapes, markings, etc. The first task is that of quickly establishing the proper gap between the vertical doorframe supports 130 and the metal track 140 on the floor. The second task is that of quickly aligning the vertical metal stud 150 in order to affix it to the metal doorframe 130. FIGS. 2A–2G illustrate the various areas and activities.

Metal track 140 is used as a guide for wall construction. Metal track 140 is installed on a floor up to the location of where a door will be positioned. A space the width of a doorframe is left between the two runs of metal track 140. The metal doorframe 130 may be positioned inside the opening. A dry wall thickness is identified, which is usually a pre-determined decision. The tool 100 accommodates ½, ⅝, ¾, 1¼ (double ⅝), and double half inch thick dry wall. The corresponding measurement is identified by markings on the tool and the appropriate slot 110 to be used is selected. The slot 110 in the tool 100 is slid onto the outside lip 135 of the doorframe 130 where the floor and frame adjoin, such that the appropriate gap is maintained between the doorframe 130 and the metal floor track 140. Each side of the doorframe 130 uses this tool 100 to establish the appropriate gap, and then the doorframe 130 is secured to the floor substrate using standard methods. Later in the construction process, dry wall is inserted into this gap created between the metal track 140 and doorframe 130.

After establishing the proper gap between the doorframe 130 and metal track 140, a metal stud 150 is installed to further secure the doorframe 130. To do this, the same slot 110 that was used to create the gap between the metal track 140 and doorframe 130 is selected on two tools 100. The tools 100 are slid onto the outside lip 135 of the metal doorframe 130 on both the entrance and exit sides. The tools 100 are moved up the doorframe 130 to the top door clip 170. The tools 100 preferably are to be parallel so as to create a pre-determined space between them. The magnets in the slots 110 keep the tools 100 in place until the work is finished. After positioning the tools 100 in the proper location, the metal door stud 150 is positioned in the fixed space between the two tools 100. This allows the door stud 150 to fit tightly into the space, establishing an alignment, and the metal stud 150 may then be affixed to the metal doorframe 130. The steps are repeated on the left and right sides of the doorframe 130.

Additionally, in an embodiment of the present invention, a numbered scale 180 is included on the outside faces of the tool 100. The numbered scale 180 may be used, for example, in conjunction with a laser tool to establish a constant elevation of the tops of multiple door frames 130 along a wall or between walls. If the block tool 100 is aligned, for example, flush to the head of a frame, a laser or other distance leveling device may be used to level a long corridor of doors using block tools 100 as a stable reference point instead of a tape measure or a stick rule which may vary and cannot easily be kept in position.

In summary, certain embodiments of the present invention afford an approach to accurately install a door frame or window frame using a rectangular block of material of certain predetermined dimensions and having slots cut into the block of material having certain other predetermined dimensions.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. Apparatus for installing a frame with a lip adjacent to a wall track comprising:

a block of material;

a slot running along a length of at least one side of said block of material; and a securing system attached to said block material to temporarily secure said block of material, along said slot, to said lip of said frame, wherein a portion of said block material is positioned between said lip of said frame and the wall track.

2. The apparatus of claim 1 wherein an edge of said slot is spaced at least ½" from an outer edge of said block.

3. The apparatus of claim 1 wherein said block of material includes at least one numbered scale on at least one outside face of said block of material.

4. A system for installing a frame including:

a block with a slot in a side of said block;

a wall track installed on a floor; and a frame with a lip, wherein said lip is positioned within said slot and said block maintains a predetermined gap between said lip and said wall track, a wall panel, wherein said predetermined gap is at least as large as a thickness of said wall panel and a portion of said wall panel is installed within said gap.

5. The system of claim 4 wherein said frame is one of a doorframe or a window frame.

6. The system of claim 4 wherein said wall panel includes single or multiple layers of wall material.

7. A system for installing a frame including:

a block with a slot in a side of said block;

a wall track installed on a floor;

a frame with a lip, wherein said lip is positioned within said slot and said block maintains a predetermined gap between said lip and said wall track; and a drywall panel, wherein said predetermined gap equals a thickness of said drywall panel.

8. A system for installing a frame including:

a block with a slot in a side of said block;

a wall track installed on a floor; and a frame with a lip, wherein said lip is positioned within said slot and said block maintains a predetermined gap between said lip and said wall track;

a wall panel with a thickness of ½", ⅝", ¾", 1", 1-¼", wherein said predetermined gap equals said thickness of said wall panel.

9. A system for installing a frame including:

a block with a slot in a side of said block, wherein said slot is along the entire length of said side of said block;

a wall track installed on a floor; and a frame with a lip, wherein said up is positioned within said slot and said block maintains a predetermined gap between said lip and said wall track.

* * * * *